United States Patent [19]

Vandenabeele et al.

[11] Patent Number: 4,670,376

[45] Date of Patent: Jun. 2, 1987

[54] PROCESS OF MAKING A PHOTOGRAPHIC ELEMENTS COMPRISING PROTECTIVE LAYERS CONTAINING ANTISTATS

[75] Inventors: Hubert Vandenabeele, Mortsel; Jacques L. Vervecken, Antwerp, both of Belgium

[73] Assignee: Agfa-Gavaert, N.V., Mortsel, Belgium

[21] Appl. No.: 790,183

[22] Filed: Oct. 22, 1985

[30] Foreign Application Priority Data

Nov. 9, 1984 [EP] European Pat. Off. ..... 84201613.1

[51] Int. Cl.[4] ..... G03C 1/82

[52] U.S. Cl. ..... 430/527; 427/154; 430/631; 430/961

[58] Field of Search ..... 430/527, 631, 961; 427/154

[56] References Cited

U.S. PATENT DOCUMENTS 3,551,152 12/1970 Mackey et al. ..... 430/527

3,552,972 1/1971 Meyer et al. ..... 430/527

4,542,035 9/1985 Steklenski et al. ..... 430/527

4,582,781 4/1986 Chen et al. ..... 430/527

*Primary Examiner*—Jack P. Brammer

*Attorney, Agent, or Firm*—A. W. Breiner

[57] ABSTRACT

Photographic elements comprising at least one protective hydrophilic colloid layer comprising at least one urethane of polyethylene oxide compounds as antistatic agent in the form of dispersed droplets having an average diameter ranging from 1500 to 12000 nm and method of covering such photographic elements with at least one such protective hydrophilic colloid layer obtained by the steps of dissolving such urethane in a water-immiscible solvent medium, emulsifying the resulting solution in aqueous hydrophilic colloid, removing said water-immiscible solvent medium by evaporation to form the dispersed droplets in the aqueous hydrophilic colloid, and coating the latter as such or after having been mixed with additional hydrophilic colloid to form the protective hydrophilic colloid layer.

7 Claims, No Drawings

PROCESS OF MAKING A PHOTOGRAPHIC ELEMENTS COMPRISING PROTECTIVE LAYERS CONTAINING ANTISTATS

The present invention relates to a method of covering photographic elements with protective hydrophilic colloid layers comprising antistatic agents as well as to photographic elements comprising a support, at least one photosensitive silver halide emulsion layer, and at least one such protective hydrophilic colloid layer.

It is known that the accumulation of electric charges during both the production and use of photographic elements may give rise to great difficulties. These static electric charges may be caused by friction between the photographic element and other contacting surfaces such as rollers and guiding members of the apparatus, through which the element runs. The static charges present in the photographic elements before development may cause spark exposure of the photosensitive silver halide emulsion, these spark-exposed areas being visualized during development in the form of irregular stripes or lines, or of dark spots. Such stripes, lines, or spots may lead to misinterpretation of the reproduced image, which is particularly harmful in the case of X-ray diagnosis. Whereas achieving an adequate antistatic behaviour in surface or outermost layers that do not essentially consist of a hydrophilic colloid, as is sometimes the case in e.g. backing layers of cinematographic materials, is not very difficult since the incorporation of electroconductive substances therein has no adverse effect, achieving a satisfactory antistatic effect in surface layers that essentially consist of a hydrophilic colloid e.g. gelatin is often very difficult to realize. As a matter of fact, not all kinds of known conductivity-increasing substances can be used in gelatin surface layers. In spite of having a satisfactory antistatic effect many of these known conductivity-increasing substances are of limited utility since they cause coating difficulties or impair the photographic and/or physical characteristics of the photographic elements, to which they had been added.

For instance, quaternary salts cannot be used in photographic elements because of their fogging influence. High concentrations of hygroscopic materials such as glycerol, potassium acetate and lithium chloride cause the surface layers of contacting photographic elements to adhere to each other. Moreover, these compounds are ineffective at low relative humidity. High molecular weight carboxylic or sulphonic acids such as sodium salts of polystyrene sulphonic acid and polyvinyl sulphonic acid have a favourable antistatic effect when applied directly to a hydrophobic support, but this positive effect is almost completely annihilated when these substances are used in hydrophilic colloid layers e.g. gelatin layers or light-sensitive gelatin silver halide emulsion layers. Chromium complexes may enter into reaction with hydrophilic colloids and can therefore be used only in limited conditions.

From U.S. Pat. No. 3,552,972 it is known that the urethanes or esters of hydroxyalkylated fatty alcohols or hydroxyalkylated alkylphenols are interesting antistatic agents. However, when added to aqueous hydrophilic colloid coating compositions, these compounds adversely affect the coating properties of the latter and as a consequence lead to irreproducible and thus less effective antistatic results. Indeed, when added as such to aqueous hydrophilic colloid coating compositions, they generally form a floating smeary film at the surface of these coating compositions, thus impeding normal coating thereof and leading to unpredictable results. When added in the form of an alcoholic solution they tend to leave the dissolved state at least partially and also form the above described floating smeary film at the surface of the coating compositions. The dissolved phase, whenever still present, is in the form of large and irregular drops. Such drops disturb the hydrophilicity of the hydrophilic colloid coating compositions so that the latter can hardly be coated on a support because of repellency spots or comets forming in the layer. Moreover, the addition of these solutions to aqueous hydrophilic colloid coating compositions often results in the formation of pinholes during the drying of the coated layer. These pinholes manifest themselves in the form of craterlike spots that are already visible before development of the photographic element and, of course, also after development thereof. Probably they are formed when the antistatic urethanes or esters locally abandon the dissolved state within some of the drops.

While in recent years the trend towards automation with enhanced and high speed transport of photographic elements has even increased the chances of accumulation of static charges therein, great emphasis is laid nowadays on the importance of using adequate antistatic agents, which satisfy the high demands imposed on photographic elements that have to be manipulated very much and treated at high speed in sizing and processing devices. An example of intensive manipulation can be found for instance in the automatic loading and unloading of X-ray film elements in cassettes, these X-ray film elements being e.g. double-coated film elements having on both sides one or more silver halide emulsion layers covered with protective gelatin layers.

It is an object of the present invention to provide photographic elements comprising a support, at least one photosensitive silver halide emulsion layer, and at least one protective hydrophilic colloid layer comprising urethanes of polyethylene oxide compounds as antistatic agents, such protective hydrophilic colloid layers presenting no problems during their coating and demonstrating a reproducible and satisfactory antistatic effect even when the photographic elements undergo extensive manipulation and/or high speed processing.

It is another object of the present invention to provide a method of covering photographic elements comprising a support and at least one photosensitive silver halide emulsion layer, with at least one protective hydrophilic colloid layer comprising such urethane antistatic agent.

Other objects of the present invention will become apparent from the disclosure herein.

The above objects have been accomplished according to the present invention by the use of urethanes as defined hereinafter, which have been dispersed in droplet form in a protective hydrophilic colloid layer of a photographic element comprising a support, at least one photosensitive silver halide emulsion layer, and at least one such protective hydrophilic colloid layer by the steps of dissolving at least one such urethane in a water-immiscible solvent medium, emulsifying the resulting solution in aqueous hydrophilic colloid e.g. aqueous gelatin by stirring, removing the water-immiscible solvent medium by evaporation to form dispersed droplets having an average diameter ranging from 1500 to 12000 nm in the aqueous hydrophilic colloid, and coating the aqueous hydrophilic colloid as such or after having been mixed with additional hydrophilic colloid to form such protective hydrophilic colloid layer on the photographic element.

The urethanes used in dispersed form in accordance with the present invention correspond to the following general formula:

$$[RO-(CH_2-CH_2-O)_{n_1}(CH_2-\underset{\underset{CH_3}{|}}{CH}-O-)_m$$

When m = 1, the resulting copolymers are block polymers and not compounds that contain ethylene oxide and propylene oxide units in statistical distribution.

Preferred urethanes are the simple compounds corresponding to the above general formula wherein m = 0 and consequently $n_2 = 0$, y = 1, and R is a $C_6$–$C_{18}$ alkyl group or an alkaryl group.

Representatives of the urethanes corresponding to the above general formula are the following:

$$C_{18}H_{37}O-(CH_2-CH_2O)_8CH_2-\underset{\underset{CH_3}{|}}{CH}-O(CH_2-CH_2-O)_8CONH-C_6H_5 \quad (I)$$

$$C_{18}H_{37}O-(CH_2-CH_2O)_8CH_2-\underset{\underset{CH_3}{|}}{CH}-O(CH_2-CH_2-O)_8CONH-C_6H_4-NO_2 \quad (II)$$

$$C_{18}H_{37}O-(CH_2-CH_2O)_8CH_2-\underset{\underset{CH_3}{|}}{CH}-O(CH_2-CH_2-O)_8CONH \quad (III)$$

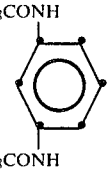

$$C_{18}H_{37}O-(CH_2-CH_2O)_8CH_2-\underset{\underset{CH_3}{|}}{CH}-O(CH_2-CH_2-O)_8CONH$$

$$C_{18}H_{37}O-(CH_2-CH_2O)_8CH_2-\underset{\underset{CH_3}{|}}{CH}-O(CH_2-CH_2-O)_8CONH \quad (IV)$$

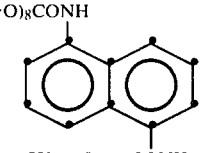

$$C_{18}H_{37}O-(CH_2-CH_3O)_8CH_2-\underset{\underset{CH_3}{|}}{CH}-O(CH_2-CH_2-O)_8-CONH$$

$$C_{16}H_{33}O-(CH_2-CH_2O)_8-CH_2-\underset{\underset{CH_3}{|}}{CH}-O-(CH_2-CH_2-O)_8CONH-C_6H_5 \quad (V)$$

$$C_{16}H_{33}O-(CH_2-CH_2O)_8-CH_2-\underset{\underset{CH_3}{|}}{CH}-O-(CH_2-CH_2-O)_8CONH-C_6H_4-NO_2 \quad (VI)$$

$$C_{14}H_{29}O-(CH_2-CH_2O)_8CONH-C_6H_4-NO_2 \quad (VII) \qquad C_{12}H_{25}O-(CH_2-CH_2O)_8CONH-C_6H_5 \quad (VIII)$$

(IX)

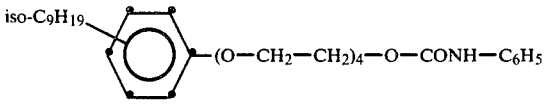

$$+(CH_2-CH_2-O)_{n_2}CO-NH]_y-R^1$$

wherein:

R represents a $C_6$–$C_{18}$ alkyl group e.g. dodecyl, tetradecyl, hexadecyl, octadecyl, an aryl group, preferably phenyl, an alkaryl group e.g. nonylphenyl, an aralkyl group e.g. benzyl or phenylethyl, or a cycloalkyl group e.g. cyclohexyl, which groups, particularly the phenyl group, may be further substituted e.g. with nitro;

y is 1 or 2;

$R^1$ is an aryl group e.g. phenyl or naphthyl when y = 1 or an arylene group e.g. phenylene or naphthylene when y = 2;

m is 0 or 1;

$n_1$ is an integer from 4 to 8;

$n_2$ is 0 or an integer from 4 to 8, $n_2$ being 0 when m = 0.

The urethanes used in accordance with the present invention can be prepared as described in U.S. Pat. No. 3,552,972.

The urethanes used in accordance with the present invention are poorly soluble in water and photographically inert. Indeed, although comprising ethylene oxide units they have no development-influencing effect. Generally, they are highly viscous, syrupy substances. In accordance with the present invention they are dispersed by first dissolving them temporarily in a water-immiscible solvent medium, then emulsifying the resulting solution in aqueous hydrophilic colloid, usually 2 to 20% by weight aqueous gelatin, preferably 5% by weight aqueous gelatin, by homogenizing e.g. stirring the solution, preferably in the presence of an anionic, cationic, or non-ionic surface-active agent, into the aqueous hydrophilic colloid, and finally removing the water-immiscible solvent medium by evaporation so that dispersed droplets of antistatic agent having an average diameter ranging from 1500 to 12000 nm remain in the aqueous hydrophilic colloid. It is assumed that some of the small droplets of antistatic agent formed during the homogenizing step grow at the expense of the other small droplets due to conglomeration taking place during the evaporation of the solvent medium.

The resulting dispersion of droplets in aqueous hydrophilic colloid, called antistatic dispersion herein, can be added as such to aqueous hydrophilic colloid coating compositions for forming antistatic protective layers of a photographic element. The antistatic dispersion can be added to the aqueous hydrophilic colloid coating compositions for forming antistatic protective layers, alone or together with other additives such as matting agents e.g.polymethyl methacrylate and polytetrafluoroethylene.

The antistatic dispersion can be prepared in bulk and stored for a long time without loosing its antistatic effect. A batch can be taken at any moment from this bulk and added to an aqueous hydrophilic colloid coating composition for forming an antistatic protective layer of a photographic element, to realize the desired antistatic effect in said photographic element.

The amount of water-immiscible solvent medium used in the preparation of the dispersion depends on the solubility of the particular antistatic agent therein. It may vary between very wide limits but is preferably limited to a minimum value, which minimum value can easily be established by making a few comparative tests.

The dispersing of the solution into aqueous hydrophilic colloid can be assisted by means of high speed stirrers, homogenizers (single or double stage homogenizers), colloid mills or ultrasonic wave generators.

The solvent or mixture of solvents constituting said water-immiscible solvent medium, from which the urethanes are dispersed in aqueous hydrophilic colloid, have a solubility in water of at most 25% by weight at room temperature (20° C.). Solvents having a solubility in water comprised between 2 and 10% by weight at room temperature are preferred. Moreover, such solvents or mixture of solvents preferably are low-boiling solvents, in other words solvents having a boiling point of at most 130° C. and they have a sufficiently high vapour pressure so that they can be removed from the aqueous dispersion by applying a vacuum of 500 to 10 mm Hg at a temperature of 25° to 80° C.

The removal of the water-immiscible solvent medium is effected by evaporation and, whenever desired, this removal can be accelerated by applying reduced pressure and/or moderate heating.

The water-immiscible solvent medium consists of a water-immiscible solvent or of a mixture of water-immiscible solvents preferably chosen from the group consisting of methylene chloride, ethyl formate, n-butyl formate, ethyl acetate, n-propyl acetate, isopropyl acetate, butyl acetate, methyl propionate, ethyl propionate, diethyl carbonate, carbon tetrachloride, sym.-dichloroethane, 1,1,2-trichloroethane, 1,2-dichloropropane, chloroform, n-butyl alcohol, amyl chloride, diethyl ketone, methyl n-propyl ketone, diisopropyl ether, cyclohexane, methylcyclohexane, ligroin (boiling range: 60°–110° C.), benzene, toluene, and nitromethane. Very good results are obtained with a water-immiscible solvent medium consisting of ethyl acetate.

At least one so-called oil-former may be added to the water-immiscible solvent medium referred to above. Suitable oil-formers for that purpose are tricresyl phospate, tributyl phthalate, dibutyl phthalate, diisooctyl phthalate, tributyl citrate, dibutyl sebacate, N,N-dimethyl palmitamide and those described in U.S. Pat. Nos. 4,430,421 and 4,430,422.

During the preparation of the antistatic dispersions of the present invention at least one anionic, cationic, or non-ionic surface-active agent must be present in the aqueous hydrophilic colloid, into which the solution of the urethane is to be dispersed. The surface-active agent is added preferably at the very stage of dispersing said solution in the aqueous hydrophilic colloid.

The amount of anionic, cationic, or non-ionic surface-active agent used in preparing the antistatic dispersion of the present invention may vary within wide limits. Generally, it is comprised between 0.5 and 20% by weight relative to the weight of the urethane to be dispersed.

Suitable surface-active agents that can be used during the preparation of the antistatic dispersion of the invention have been described in U.K. Pat. Nos. 1,293,189 and 1,460,894, in BE Pat. No. 742,680, and in U.S. Pat. No. 4,292,402. A survey of surface-active agents that can be used during the preparation of the antistatic dispersion of the invention can be found in Gerhard Gawalek's "Wasch- und Netzmittel" Akademieverlag, Berlin (1962). Examples of suitable surface-active agents are the sodium salt of N-methyl-oleyltauride, sodium stearate, heptadecenylbenzimidazole sulphonic acid sodium salt, sodium sulphonates of higher aliphatic alcohols e.g. 2-methyl-hexanol sodium sulphonate, sodium diiso-octyl-sulphosuccinnate, sodium dodecyl sulphate, tetradecyl benzene sulphonic acid sodium salt. It is advisable to use fluorinated surface-active agents e.g. perfluorocaprylic acid ammonium salt as they have an antistatic effect of their own and demonstrate an even more prominent antistatic effect when used together with a matting agent in a protective hydrophilic colloid layer of a photographic element as described in U.K. Pat. No 1,293,189.

The urethanes used in accordance with the present invention are employed in quantities of 10 to 200 mg per square meter of the resulting coated antistatic protective layer, preferably of 50 to 100 mg per square meter of antistatic protective layer.

Although gelatin is used customarily as aqueous hydrophilic colloid in the preparation of the antistatic dispersion of the invention, other hydrophilic and water-permeable film-forming substances, e.g. proteins other than gelatin, cellulose derivatives such as alkyl cellulose for instance hydroxyethyl cellulose or carboxymethyl cellulose, alginic acid and derivatives thereof, gum arabic, polyvinyl alcohols, polyvinyl pyrrolidone and even mixtures thereof can be employed as well.

Likewise gelatin is currently used as hydrophilic colloid in the hydrophilic colloid coating composition, to which the antistatic dispersion of the present invention is to be added before this hydrophilic colloid coating composition is coated to form an antistatic protective layer of a photographic element. Of course, the other hydrophilic and water-permeable film-forming substances mentioned above can also be employed instead of or combined with gelatin.

The antistatic dispersion of the invention can be used normally in antistatic protective layers such as antistress layers but it can also be employed in photosensitive silver halide emulsion layers, antihalation layers and NC-layers for black-and-white or colour photographic films. They are particularly interesting for use in protective layers of X-ray materials. They do not cause fogging, do not accelerate development, do not migrate from the layers, and do not cause sticking of the layers.

If desired matting agents can be added together with the antistatic dispersion to the hydrophilic colloid coating compositions for forming antistatic protective layers, so that heterogeneously distributed particles having a size of 1–3 microns are formed in these antistatic protective layers. Smooth layers that have an excellent antistatic effect are obtained thereby.

Other additives such as i.a. plasticizers, filling agents, hardening accelerators, antifriction agents, anti-Newton additives can also be added to the hydrophilic colloid coating compositions for forming the antistatic protective layers.

The silver halide used in the preparation of the photosensitive silver halide emulsion layers of the photographic elements according to the present invention can be silver bromide, silver iodide, silver chloride, or mixed silver halides e.g. silver chlorobromide and silver bromoiodide.

The photosensitive silver halide emulsion layers of the photographic elements according to the present invention may contain the usual additives such as e.g. stabilizers, fog-inhibitors, speed-increasing compounds, colloid hardeners, plasticizers etc. The silver halide emulsions may be spectrally sensitized or non-spectrally sensitized.

The following example illustrates the present invention.

EXAMPLE

A gelatin silver bromoiodide (2 mol % of iodide) X-ray emulsion comprising per kg 80 g of gelatin and an amount of silver halide corresponding to 190 g of silver nitrate was coated on both sides of a subbed polyethylene terephthalate support at a ratio of 1 kg covering 27 sq. m per side of the support.

Five Batches A to E of hydrophilic colloid coating composition for forming antistatic protective layers were prepared.

Batch A was a coating composition comprising per liter 30 g of gelatin and 7.5 ml of a 5% aqueous solution of the ammonium salt of perfluorocaprylic acid as surface-active agent;

Batch B was a same coating composition as Batch A, into which, however, per liter of coating composition 1.5 ml of the above-mentioned compound IX had been stirred;

Batch C was a same coating composition as Batch A, into which, however, per liter of coating composition 15 ml of a 10% methanolic solution of the above-mentioned compound IX had been stirred;

Batch D was a same coating composition as Batch A, into which, however, per liter of coating composition 30 g of a 5% antistatic dispersion had been stirred, which had been prepared by emulsifying a temporary sqlution of compound IX in ethyl acetate into 5% by weight aqueous gelatin with stirring and subsequently removing the ethyl acetate by evaporation, the stirring having been such that the resulting disperse drops of compound IX had a diameter averaging about 1300 nm;

Batch E was a same coating composition as Batch D with the difference that the stirring had been such that the resulting disperse drops of compound IX had a diameter averaging about 8000 nm.

The resulting five Batches A to E were examined twice for comparison; a first time immediately after their preparation and a second time after having been left standing for two days.

Batch A appeared to be unaltered during the second examination, whereas in Batch B the antistatic compound IX appeared to have formed an oily film at the surface of the coating composition.

During the first examination Batch C appeared to comprise disperse droplets consisting of antistatic compound IX dissolved in methanol but during the second examination the antistatic compound IX appeared to have left the dissolved state at least partially and formed an oily film at the surface of the coating composition. The dissolved phase that was still present had taken the form of large and irregular drops in the coating composition.

During the first examination Batches D and E appeared to consist of aqueous gelatin comprising disperse drops of antistatic compound IX; during the second examination Batches D and E, unlike Batches B and C, appeared to show no change whatsoever.

Five strips of the above emulsion-coated support were coated on both sides while still wet with Batches A, B, C, D, and E respectively that had been left standing for two days after their preparation. Both antistatic protective layers were coated at a ratio of 27 sq. m. per liter of coating composition, which means that per sq. m. and on each side of the support about 1.1 g of gelatin was present. The concentration of compound IX in each of the antistatic protective layers coated from the Batches B, C, D, and E was approximately 75 mg per sq. m.

Coating of the Batches B and C was very difficult and if the coating succeeded at all the reproducibility of the coating results was extremely poor. Coating of the Batches A, D, and E was easy and reproducible.

The five strips were stored for 3 days at 57° C. and a relative humidity of 34%. Each of them was cut into four samples.

A first series of samples consisting of a sample of each of the five strips coated with Batches A, B, C, D, and E respectively was rubbed against a brass surface, a second series against a rubber surface, a third against a polyvinyl chloride surface, and a fourth against an intensifying calcium tungstate screen, the rubbing being performed in the dark.

All twenty samples were then developed identically to make visible the discharge images produced in the emulsion layers by the sparks formed during the rubbing. The discharge images were then evaluated. An appreciation of these evaluations is given in the following Table 1 ; the values listed therein should be interpreted as follows: 0 stands for excellent, 1 stands for very good, 2 stands for good, 3 stands for unsatisfactory, 4 stands for poor antistatic behaviour, and 5 for no antistatic effect at all. Intermediate values between the above integers up to one decimal can be found in the Table. Table 1 also gives the sum of the values of the four samples cut from a same strip and rubbed against the different surfaces.

TABLE 1

| Antistatic protective layer coated from | Discharge evaluations after having been rubbed against | | | | Sum of |
|---|---|---|---|---|---|
| Batch | Brass | Rubber | PVC | Screen | evaluations |
| A | 0.1 | 1.0 | 4.5 | 5.0 | 10.6 |
| B | 0.0 | 0.1 | 1.0 | 1.0 | 2.1 |
| C | 0.1 | 0.1 | 1.5 | 1.0 | 2.7 |
| D | 0.1 | 1.0 | 4.5 | 4.5 | 10.1 |

TABLE 1-continued

| Antistatic protective layer coated from | Discharge evaluations after having been rubbed against | | | | Sum of |
|---|---|---|---|---|---|
| Batch | Brass | Rubber | PVC | Screen | evaluations |
| E | 0.0 | 0.1 | 1.2 | 0.1 | 1.4 |

These results learn that the antistatic effect obtained with the antistatic dispersion of the present invention, which comprises compound IX in the form of dispersed droplets having an average diameter of 8000 nm is excellent and exceeds that of the comparison materials. In contrast, the antistatic effect obtained with the antistatic dispersion comprising compound IX in the form of dispersed droplets having an average diameter of 1300 nm is very poor.

Summarizingly, it can be said that the coating of the antistatic protective layer from Batch E was easy and reproducible and that the resulting antistatic protective layer showed a highly satisfactory antistatic effect, which makes it extremely apt for application in photographic elements undergoing extensive manipulation and/or high speed processing.

We claim:

1. Method of covering photographic elements comprising a support and at least one photosensitive silver halide emulsion layer with at least one protective hydrophilic colloid layer comprising a urethane antistatic agent corresponding to the following general formula:

$$[RO-(CH_2-CH_2-O)_{n1}(CH_2-\underset{\underset{CH_3}{|}}{CH}-O)_m-(CH_2-CH_2-O)_{n2}CO-NH]_y-R^1$$

wherein:

R represents a $C_6$–$C_{18}$ alkyl group, an aryl group, an alkaryl group, an aralkyl group, or a cycloalkyl group, which groups may be further substituted;

y is 1 or 2;

$R^1$ is an aryl group when y=1 or an arylene group when y=2;

m is 0 or 1;

$n_1$ is an interger from 4 to 8;

$n_2$ is 0 or an integer form 4 to 8, $n_2$ being 0 when m=0, wherein said method comprises the steps of dissolving at least one said urethane in a water-immisicible solvent medium having a boiling point of at most 130° C., said water-immiscible solvent medium being present in amounts sufficient to dissolve said urethane, emulsifying the resulting solution in aqueous hydrophilic colloid by stirring, removing said water-immiscible solvent medium by evaporation by applying a vacuum of 500 to 10 mm Hg at a temperature of 25° to 80° C. to form dispersed droplets having an average diameter ranging from 1500 to 12000 nm in said aqueous hydrophilic colloid, and coating said aqueous hydrophilic colloid as such or after having been mixed with additional hydrophilic colloid to form said protective hydrophilic colloid layer, said urethane being present therein in quantities of 10 to 200 mg per square meter.

2. Method according to claim 1. wherein said urethane antistatic agent corresponds to the following structural formula:

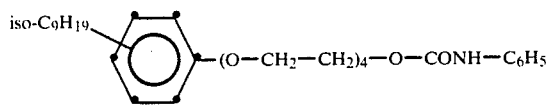

3. Method according to claim 1, wherein said aqueous hydrophilic colloid is aqueous gelatin.

4. Method according to claim 1, wherein said resulting solution is emulsified by stirring it into said aqueous hydrophilic colloid in the presence of an anionic, cationic, or non-ionic surface-active agent.

5. Method according to claim 4, wherein said surface-active agent is a fluorinated surface-active agent.

6. Method according to claim 5, wherein said fluorinated surface-active agent is perfluorocaprylic acid ammonium salt.

7. Method according to claim 5, wherein said fluorinated surface-active agent is used together with a matting agent.

* * * * *